US005097986A

United States Patent [19]

Domberg et al.

[11] Patent Number: 5,097,986

[45] Date of Patent: Mar. 24, 1992

[54] VENDING MACHINE

[75] Inventors: Hans Domberg, Hüllhorst; Georg Seidel, Minden; Rolf Renner, Lübbecke, all of Fed. Rep. of Germany

[73] Assignee: Deutsche Wurlitzer GmbH, Hullhorst, Fed. Rep. of Germany

[21] Appl. No.: 509,941

[22] Filed: Apr. 16, 1990

[30] Foreign Application Priority Data

Apr. 17, 1989 [DE] Fed. Rep. of Germany ..... 3912903

[51] Int. Cl.[5] ..... G07F 11/72

[52] U.S. Cl. ..... 221/150 R; 312/4; 221/75; 221/97; 221/130; 221/131; 221/155; 221/195

[58] Field of Search ..... 221/97, 75, 129–131, 221/150 R, 155, 194, 195; 312/4

[56] References Cited

U.S. PATENT DOCUMENTS

| | | | |
|---|---|---|---|
| 140,130 | 6/1873 | Fowler | 312/4 |
| 2,272,750 | 2/1942 | Miller | 221/150 R |
| 2,604,371 | 7/1952 | Smiley et al. | 221/150 R |
| 3,269,595 | 8/1966 | Krakauer et al. | 221/75 |
| 3,351,233 | 11/1967 | Chanoch et al. | 221/131 |
| 4,046,440 | 9/1977 | Cox et al. | 221/75 |
| 4,108,333 | 8/1978 | Falk et al. | 221/130 |
| 4,823,984 | 4/1989 | Ficken | 221/97 |
| 4,920,764 | 5/1990 | Martin | 221/150 R |

*Primary Examiner*—H. Grant Skaggs

*Attorney, Agent, or Firm*—Merchant, Gould, Smith, Edell, Welter & Schmidt

[57] ABSTRACT

Presented is a vending machine with an outer door, a space for merchandise capable of being seen through the outer door and filled with merchandise, and with additional units, as for example coin changer/coin counter, etc., adjacent to the merchandise space, which are lockable with the outer door. The merchandise space is cooled by a cooling assembly and the vending machine displays means that reduce cold losses during operation, in particular at the time of dispensing merchandise, removal of merchandise and/or refilling with merchandise. In this manner, it is also possible to offer and sell with the vending machine cooled merchandise, in particular low-temperature-cooled merchandise.

9 Claims, 6 Drawing Sheets

VENDING MACHINE

The invention concerns a vending machine with an outer door, a space for merchandise capable of being seen through the outer door and filled with merchandise, and with the additional units, as for example coin. changer/coin counter, etc., adjacent to the merchandise space, which are lockable with the outer door.

These types of vending machines, where the merchandise offered for sale, for example packages of sweets or the like, is displayed in well-visible fashion behind an outer door, have been known for many years and are used with great sales success for the merchandise being offered.

This sales success is founded on the fact that the merchandise offered for sale—predominantly in a particularly attractive packaging —can be viewed directly by the potential buyer, which represents a considerable stimulus to buy, in that a relationship is generated between the attractive merchandise and the observer. Because of the visibility of the merchandise, also drawn into the purchaser circle are particularly children and youths, since in their case the visual contact with the merchandise can, to a great measure, give impetus to the decision to buy.

Disadvantageous in the case of the known vending machines of the initially-mentioned type is that these types of vending machines—with a direct view onto the merchandise offered—are laid out only for merchandise that can be stored at room temperature or with a low amount of cooling in the merchandise space of the vending machine. Because of a great isolating problem during operation, in particular when delivering the merchandise and/or refilling with merchandise, and the therewith-associated uneconomical cold losses, the vending machines of the initially-mentioned type have up until now not been able to be equipped, from the economic point of view, with low-temperature cooling, e.g. for offering ice cream or low-temperature-cooled menus. Up until the present time, ice cream has been able to be dispensed only from vending machines where the ice cream in the merchandise space of the vending machine is stored out of the sight of a potential buyer, so that the above-mentioned stimulus to buy drops away.

The object of the present invention is to further develop a vending machine of the initially-mentioned type such that cooled merchandise, in particular low-temperature-cooled merchandise can be offered for sale. This objective is met in accordance with the invention in the case of a vending machine of the initially-mentioned type due to the fact that the vending machine contains a cooling unit that cools the merchandise space, and that means are provided that reduce cold losses during operation of the vending machine when dispensing merchandise and/or refilling with merchandise.

The advantages of this vending machine in accordance with the invention lie particularly in the fact that low-temperature-cooled merchandise can also be offered in easily-visible fashion, for a potential buyer, in the cooled merchandise space whereby, in the case of this type of merchandise, also capable of being achieved is a considerable increase in the stimulus to buy. Using the means provided for in accordance with the invention for reducing cold losses, vending machines for low-temperature-cooled merchandise can be operated economically.

Preferred further developments of the invention are given in the subclaims.

Since, for example, for removal of the money taken in from the coin container or for the purpose of possibly required changes in selling prices, the outer door of the vending machine has to be opened, in order to avoid cold losses preferably provided for is that the foregoingly-mentioned means include an isolating glass door that extends over the front opening of the merchandise space and closes off the merchandise space in sealing fashion. In this manner, the cooled merchandise space can be maintained closed up until the time that filling with merchandise has to be undertaken. On the other hand, if the operator needs only get to the subsidiary units, and, for example, needs only to remove coins or refill with money for making change, then only the outer door needs to be opened, the isolating glass door remains closed and can maintain the merchandise space at its temperature.

Preferably, the outer door displays a cutout in front of the front opening of the merchandise space. For reasons of cost, glazing of the outer door is avoidable.

When filling the merchandise into the cooled vending machines, it is advantageous if the merchandise can be refilled as rapidly as possible in order to limit the required opening of the merchandise space to as short a period of time as possible. For this purpose, according to a further development of the invention, advantageously provided is that merchandise compartments be arranged in the merchandise space from which - after appropriate selection and appropriate deposit of coins - the merchandise can be dispensed by means of a delivery arrangement into a removal container, via a drop chute.

Also, with dispensing of the purchased merchandise, in order to reduce cold losses via the connection formed by the drop chute between the cooled merchandise space and the uncooled removal container, advantageously provided is that the above-mentioned means include a first closable trap door between the lower end of the drop chute and the removal container that opens only when merchandise is being dispensed through the delivery arrangement. As a further development to this, provision can be made so that the merchandise, after delivery through the delivery arrangement, falls onto the first closable trap door which is then opened in motor-driven fashion, so that the merchandise package purchased falls into the removal container, where the buyer can then remove it.

A preferred embodiment of the delivery arrangement consists in the fact that it is disposed horizontally in the merchandise compartment, displays about its longitudinal axis motor-driven, rotatable coils between whose turns the merchandise is stored, and that the merchandise is delivered into the removal container by rotation of the coils.

Preferably, the merchandise compartments to be filled with merchandise can be pulled out, at least partially, of the merchandise space form the front side - after opening the isolating glass door. In this way, only a small part of the still-available merchandise will be removed from cooling during the filling process.

Also, in order to reduce cold losses that occur during refilling with merchandise, provided in accordance with a further development of the invention is that the foregoingly-mentioned means contain at least one window shade or Venetian blind, with which the front opening of the merchandise space is capable of being closed off to a great extent in the region of the other merchandise compartments while filling—possibly partially pulled-out—merchandise compartments, and that is capable of being displaced from the region of the front opening after completing filling. In this way, it is possible to keep the cooled merchandise space closed up until the time of an access-opening to a particular merchandise compartment—or also for pulling out this merchandise compartment.

Preferably, each window shade and/or each Venetian blind is slidingly guided laterally in two guide rails and, furthermore, the guide rails are, in particularly preferred manner, attached in a fashion running about the side walls of the merchandise space. In this way, each window shade and/or each Venetian blind is capable of being displaced during normal operation of the vending machine, i.e. with a closed isolating glass door, on the upper or lower and/or the back side of the merchandise space, where the window shade and/or the Venetian blind does not impair free visibility onto the merchandise offered.

In order to reduce the rise in temperature of the merchandise compartments and therewith of the merchandise during the refilling process, advantageously provided is that the means also include cold accumulators that are attached to the merchandise compartments. It is particularly advantageous that the cold accumulators be attached under the floor of the merchandise compartments in the region of the front opening of the merchandise space. In this manner, generated in the region of the front opening of the merchandise space is an auxiliary "cold supply", and/or with a pulled-out merchandise compartment, the remaining merchandise still located therein, which at this point in time is now located outside of the cold merchandise space, is additionally cooled.

A further reduction of cold losses and a therewith-associated increasing of the economy of the vending machine is achievable by a further development of the invention, according to which the means for reducing the cold losses include an isolating layer with which the merchandise space is surrounded. Explained in more detail in the following with the aid of a drawing is a preferred form of embodiment of the invention.

Figure 1:
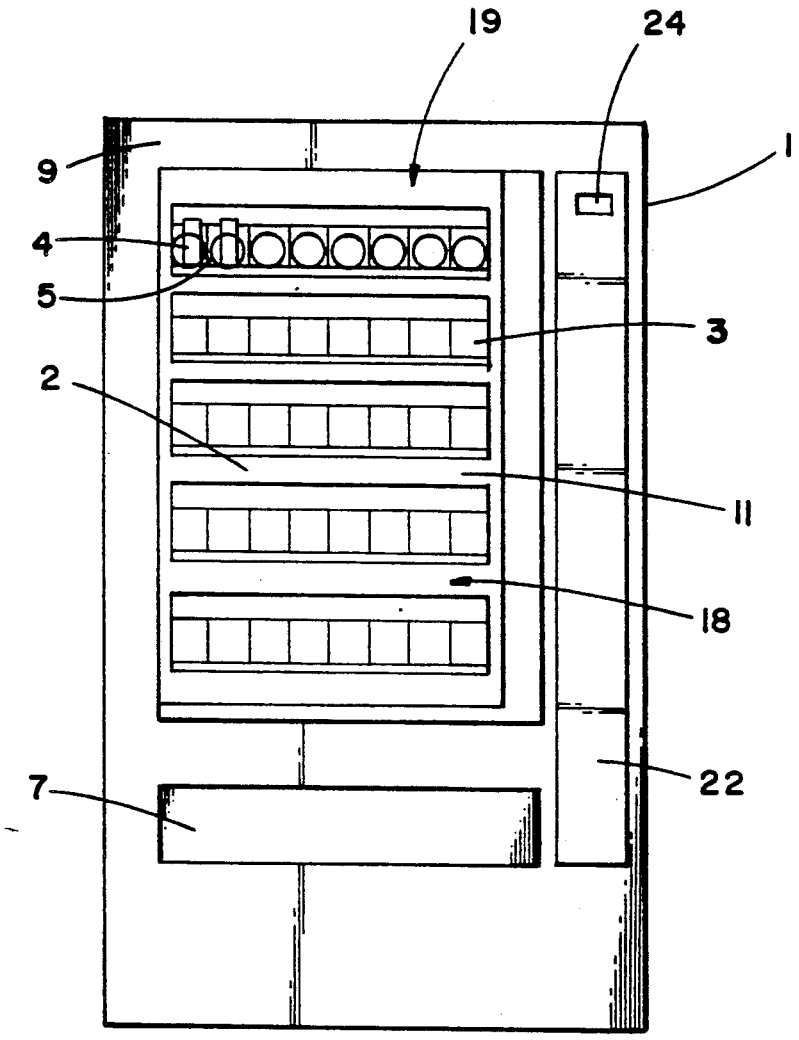
FIG. 1 shows a front view of the vending machine in accordance with the invention.

FIG. 1 shows a front view of a vending machine 1 with a closed outer door 9 that extends over the entire width of the vending machine. therefore also covers the subsidiary units, and, in the region of the front opening 19 of the merchandise space 18, has a cutout 2. Further attached in front of the merchandise space 18 is an isolating glass door 11 that extends only over the opening 19 of the merchandise space 18 and enables a separate opening and sealing-closing of the merchandise space 18 and, in the closed condition, lies against a corresponding, circumventing seal.

Visible through the cutout 2 of the outer door 9 is the merchandise 4 located in the merchandise space 18, that is kept ready in horizontally, displaceably-supported merchandise compartments 3 in coils 5 that are rotatable in motor-driven fashion about their longitudinal axis. The coils 5 are rotated when the appropriate merchandise compartment 3 would have been selected in the operating field 22 and an appropriate deposit of coins made in the coin slot 24. By rotation of the appropriate coil 5, the forwardmost merchandise package of the selected merchandise is moved forwardly by a certain amount toward the front opening 19, whereafter it falls through a drop chute 20 into a removal container 6 (FIG. 2), from which it can then be taken out through a front trap door 7.

Figure 2:
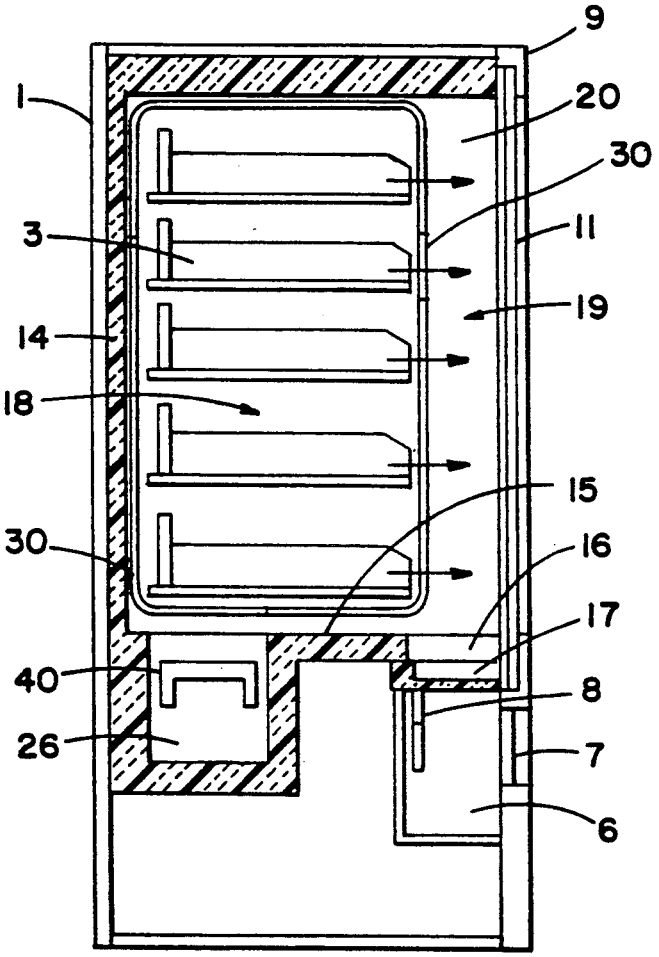
FIG. 2 shows a side view of the vending machine in accordance with FIG. 1.

FIG. 2 shows the vending machine 1 in a side view from which becomes clear, in particular, the sectioning of the coolable merchandise space 18 into several displaceable merchandise compartments 3 that can be partially pulled out from the merchandise space 18 in the direction of the represented arrows. After choosing a particular merchandise, a corresponding merchandise package is moved by the delivery arrangement (essentially the motor-driven, rotatable coils 5) toward the front opening 19 of the merchandise space 18, until the merchandise package falls, via the drop chute 20, through the opening 16 between the drop chute 20 and the removal container 6, into the removal container 6, and can be removed there through the front trap door 7. To avoid cold losses through the opening 16, provided for closing off this opening is another, closable trap door 17 that opens when a merchandise package is dispensed by the delivery arrangement, and which, for example, closes again after removal of the merchandise package. The removal container 6, besides the front trap door 7, also has a rear trap door 8 that is coupled mechanically with the front trap door 7 such that the rear trap door 8 closes when the front trap door 7 is opened, and vice-versa.

The merchandise space 18 is surrounded up to its front opening 19 by an isolating layer 14 that makes a further contribution to reducing cold losses. On the underside 15 of the merchandise space 18, the isolating layer 14 surrounds a space 26 for the cooling assembly 40.

Figure 3:
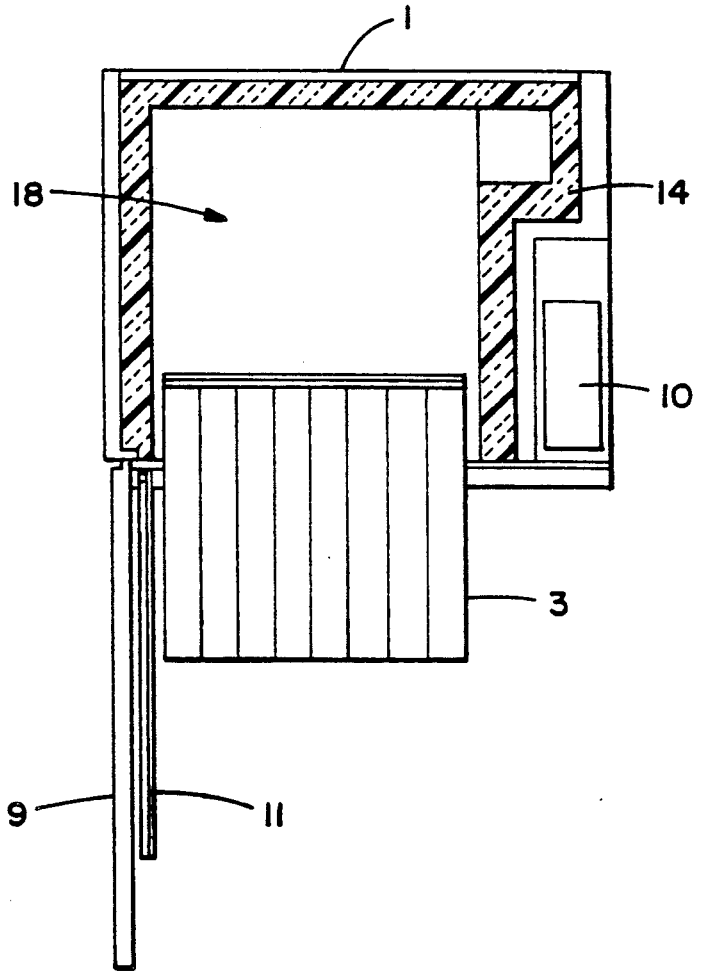
FIG. 3 shows a top view onto the vending machine in accordance with FIG. 1 and 2 with opened outer door and opened isolating glass door, as well as pulled-out merchandise compartments.

FIG. 3 shows the vending machine 1 in a top view with opened outer door 9 and likewise opened—serving as inner door—isolating glass door 11, and partially pulled-out merchandise compartments 3. While the representation of FIG. 1 and 2 show the vending machine 1 in the normal operating condition while the merchandise offered and/or delivered is being removed therefrom, represented here is the refilling condition. Opening the isolating glass door 11 is required only after refilling of merchandising 4 into the merchandise compartments 3. For removal of the money collected from the coin container 10 or, for example, for changing selling prices, the cooled merchandise space 18 can remain closed, since the subsidiary units are accessible by opening only the outer door 9.

Figure 4:
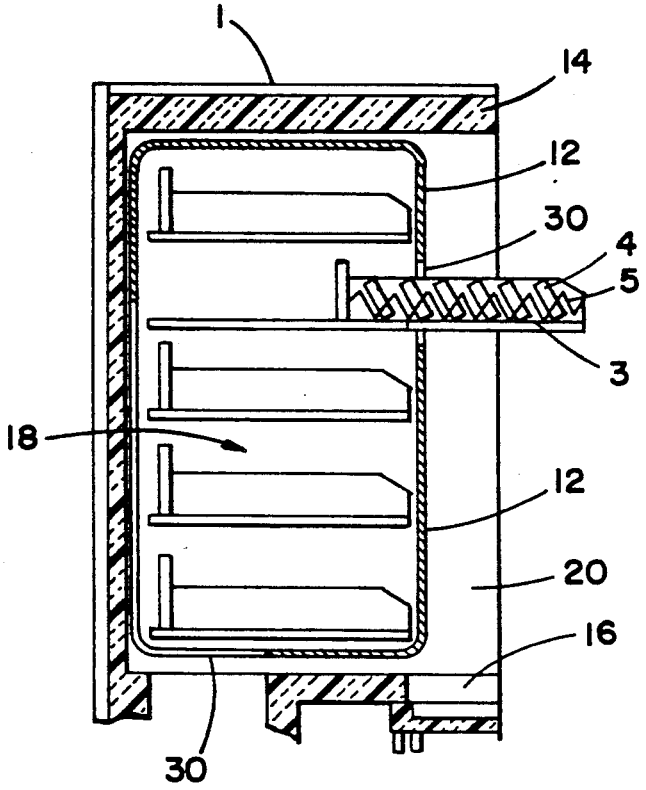
FIG. 4 shows an enlarged, sectional representation of the side view of the vending machine in accordance with FIG. 2, with a partially pulled-out merchandise compartment and with a window shade covering the front opening of the merchandise space in the region of the other merchandise compartments.
Figure 5:
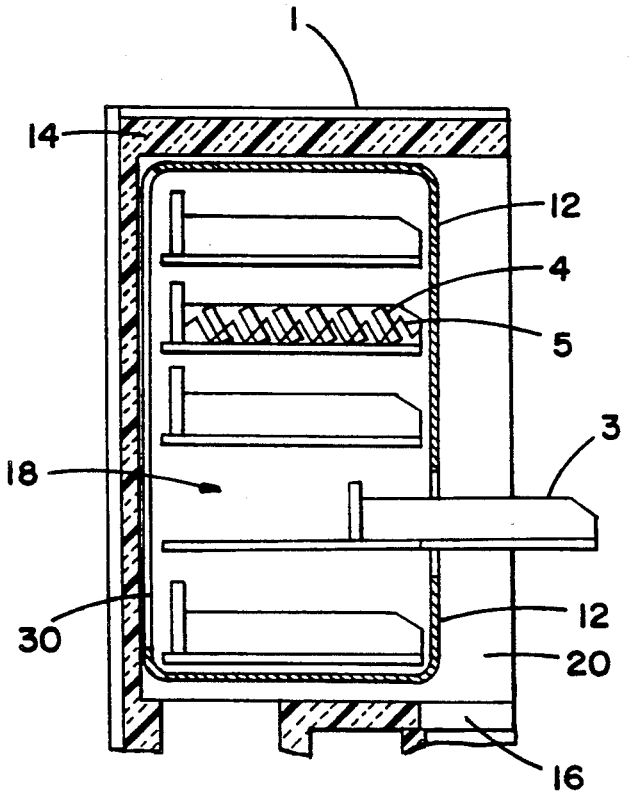
FIG. 5 shows a representation of the vending machine corresponding to FIG. 4, where another merchandise compartment is partially pulled out for filling.

Shown in particular in FIG. 4 and 5 is the merchandise space 18 of the vending machine 1 in an enlarged representation when filling it with merchandise. For the filling process, the non-represented outer door 9 and the likewise non-represented isolating glass door 11 is opened and the merchandise compartment 3 to be filled is partially pulled out of the merchandise space 18. In order to reduce cold losses occurring because of the opened isolating glass door 11, provided are two (isolating) window shades 12 that to a great extent close off the front opening 19 of the merchandise space 18 above and below the pulled-out merchandise compartment 3, hence in the region of the other merchandise compartments. The opening that remains for pulling through a merchandise compartment can be variably configured by displacing the window shade, which becomes clear with the aid of FIG. 5. There, another merchandise compartment 3 lying further below, for filling with merchandise 4, is pulled out from the merchandise space 18. The two window shades are guided laterally in sliding fashion in guide rails 30 that are attached, or in particular engaged there, to the side walls of the merchandise space 18. The guide rails 30 run about on the side walls of the merchandise space 18 such that the window shades 12—for example like in the case of a Venetian blind casing—can be pushed out from the region of the front opening 9 toward the top side, the bottom side or also behind the back side of the merchandise space 18, as soon as the refilling process has been ended. The merchandise space 18 is then again freely visible.

Figure 6:
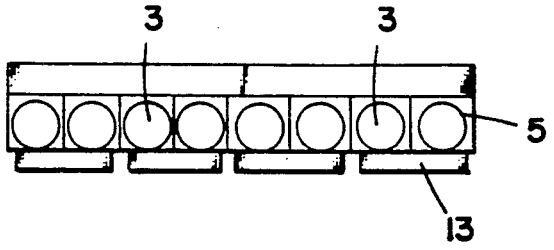
FIG. 6 shows an enlarged front view of the merchandise compartments with cold accumulators attached thereunder.
Figure 7:
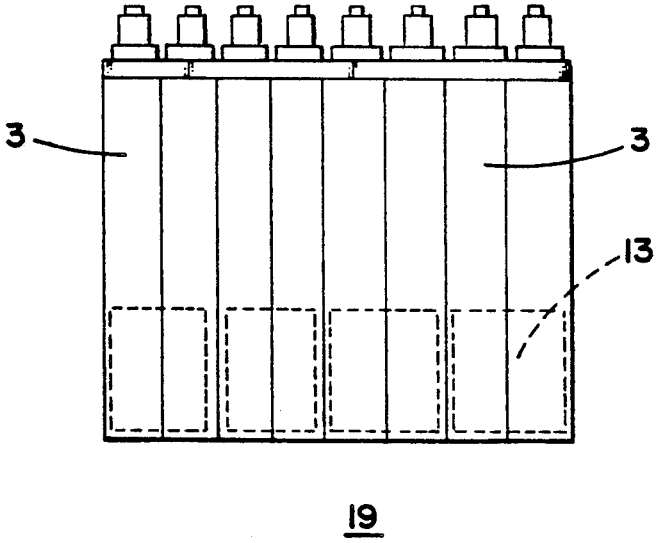
FIG. 7 shows a top view onto the merchandise compartments in accordance with FIG. 6.

With the aid of FIG. 6 and 7 it becomes clear that attached underneath the floor of the merchandise compartments 3, in particular in the region of the front opening 19 of the merchandise space 18, are cold accumulators 13 which, with a pulled-out merchandise compartment 3, protect the remaining merchandise located therein against excessive cold losses.

We claim:

1. A vending machine for displaying and dispensing merchandise, comprising:

a plurality of sidewalls defining a merchandise space within said vending machine for holding said merchandise, substantially surrounded by a thermal isolating layer and having at least one front opening;

a drop chute adjacent to said front opening which leads to a removal container;

an outer door for substantially enclosing said vending machine, with a transparent portion through which said merchandise space can be viewed;

a coin receiver adjacent to said merchandise space which is sealed behind said outer door;

a cooling assembly which cools said merchandise space;

an isolating glass door that extends over said front opening of said merchandise space and closes off said merchandise space in sealing fashion to reduce cold losses;

a plurality of window shades between said isolating glass door and said merchandising space, positioned to selectively seal at least part of said front opening, thereby reducing cold losses when said isolating glass door is opened to provide access to said merchandise; and a motor operated closable trap door between the lower end of said drop chute and said removal container, which opens only when said merchandise is dispensed.

2. The vending machine according to claim 1 wherein a plurality of merchandise compartments are disposed in said merchandise space for dispensing said merchandise into said drop chute.

3. The vending machine according to claim 2 wherein said merchandise compartments contain rotatable coils with motors about their longitudinal axis, said merchandise being stored between said coils and dispensed into said drop chute when said coils rotate.

4. The vending machine according to claim 2 wherein said merchandise compartments can be partially pulled out of said merchandise space to provide access to said merchandise.

5. The vending machine according to claim 4 wherein said window shades can be positioned to allow one or more of said merchandise compartments to be partially pulled out of said merchandise space, while substantially sealing the remainder of said front opening.

6. The vending machine according to claim 2 wherein cold accumulators are attached to said merchandise compartments.

7. The vending machine according to claim 6 wherein said cold accumulators are attached under the floor of said merchandise compartments in the region substantially near said front opening.

8. The vending machine according to claim 1 wherein said window shades are guided laterally in sliding fashion in a plurality of guide rails.

9. The vending machine according to claim 8 wherein said guide rails are attached in surrounding fashion to the side walls of said merchandise space.

* * * * *

UNITED STATES PATENT AND TRADEMARK OFFICE

CERTIFICATE OF CORRECTION

PATENT NO. : 5,097,986
DATED : March 24, 1992
INVENTOR(S) : Domberg, et al

It is certified that error appears in the above-indentified patent and that said Letters Patent is hereby corrected as shown below:

In the ABSTRACT, delete the text of the Abstract and insert therefor:

--A vending machine with a merchandise space for holding merchandise, substantially surrounded by a thermal isolating layer and having at least one front opening. A drop chute leads to a removal container adjacent to the front opening of the merchandise space. The outer door substantially encloses the vending machine, while allowing the merchandise space to be viewed. The coin changer and other mechanisms are adjacent to the merchandise space and are sealed behind the outer door. A cooling assembly cools the merchandise space. An isolating glass door extends over the front opening of the merchandise space and closes off the merchandise space in sealing fashion to reduce cold losses. A plurality of window shades located behind the isolating glass door are positioned to selectively seal at least part of the front opening of the merchanidse space, thereby reducing cold losses when the isolating glass door is opened during removal or refilling of the merchandise. A first closable trap door, operated by motor, is located between the lower end of the drop chute and the removal container which opens when the merchandise is dispensed.

Signed and Sealed this

Twenty-sixth Day of September, 1995

Bruce Lehman

*Attest:*

BRUCE LEHMAN

*Attesting Officer*

*Commissioner of Patents and Trademarks*